US009907123B2

(12) United States Patent
Hofmann et al.

(10) Patent No.: US 9,907,123 B2
(45) Date of Patent: Feb. 27, 2018

(54) MICROWAVE SEALING DEVICE OF AN OPENING FOR A ROTATING SHAFT

(75) Inventors: Arnd Hofmann, Lulsfeld (DE); Norbert Danzer, Gebsattel (DE); Abdel-Ilah Zbat, Wurzburg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 391 days.

(21) Appl. No.: 13/263,212

(22) PCT Filed: Apr. 29, 2010

(86) PCT No.: PCT/EP2010/002627
§ 371 (c)(1),
(2), (4) Date: Dec. 12, 2011

(87) PCT Pub. No.: WO2010/127804
PCT Pub. Date: Nov. 11, 2010

(65) Prior Publication Data

US 2012/0091127 A1 Apr. 19, 2012

(30) Foreign Application Priority Data

May 2, 2009 (EP) ..... 09006046

(51) Int. Cl.
*H05B 6/76* (2006.01)

(52) U.S. Cl.
CPC ..... *H05B 6/76* (2013.01)

(58) Field of Classification Search
CPC ..... A61M 5/445; H05B 6/76; H05B 6/763; H05B 6/72; H05B 6/74; H05B 6/6402; H05B 6/6411
(Continued)

(56) References Cited

U.S. PATENT DOCUMENTS 3,321,604 A 5/1967 Stecca et al.
3,587,010 A * 6/1971 Walsh ..... H01P 1/042 285/368
(Continued)

FOREIGN PATENT DOCUMENTS

DE 2834368 2/1980
DE 3027839 A1 * 2/1982
(Continued)

OTHER PUBLICATIONS

Machine translation: JP2001-126859A: Micorwave heating unit, Hyodo, May 11, 2001, 5 pages. JP2003068444A: Vacuum microwave thawing machine, Ito, Mar. 7, 2003, 13 pages. DE3027839A1:Microwave heating unit has dish shaped sealing plate, Abdin, Feb. 11, 1982. DE4135819A1: Microwave trap for microwave oven circulation fan drive shaft, Bosch, May 6, 2019.*
(Continued)

*Primary Examiner* — Dana Ross
*Assistant Examiner* — Kuangyue Chen
(74) *Attorney, Agent, or Firm* — Pearne & Gordon LLP

(57) ABSTRACT

The present invention relates to a microwave sealing device of an opening for a rotating shaft (26) or axle. The sealing device (10; 30; 50) is provided for enclosing a section of the shaft (26) or axle. The sealing device (10; 30; 50) includes a front panel (12; 32; 52) and a basis part (14; 34; 54). The front panel (12; 32; 52) is formed as a plane disk and comprises a central hole (16; 36; 56) in its center and a plurality of cuts (20; 40; 58, 60). The basis part (14; 34; 54) is formed as a hollow part with a peripheral wall and two opposing face sides. At least one of the two opposing face sides of the basis part (14; 34; 54) is open. The basis part (14; 34; 54) comprises a plurality of cuts (22; 42; 62) in the peripheral wall. The front panel (12; 32; 52) is attached at
(Continued)

Figure 1:
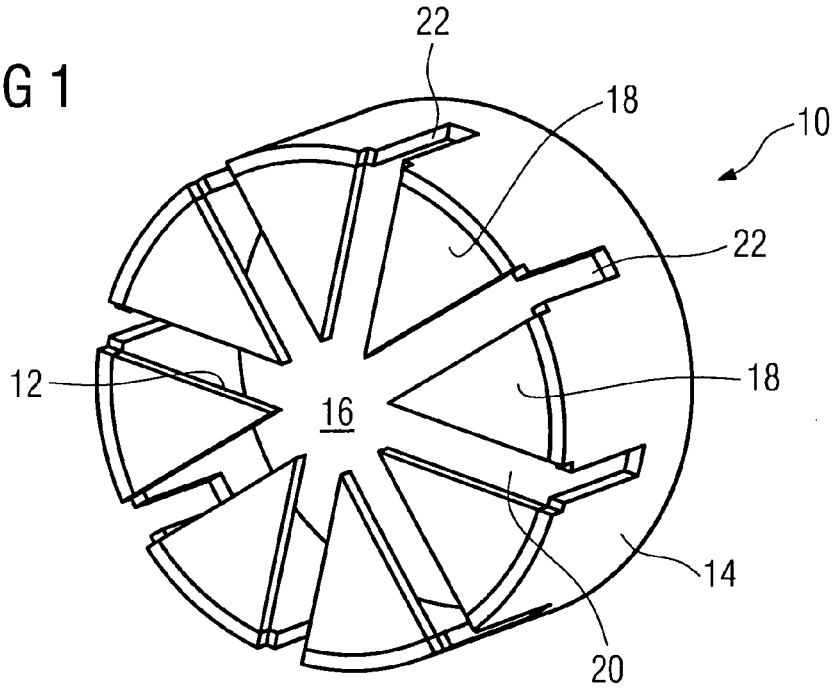

the open face side or at one of the two open face sides, respectively, of the basis part (14; 34; 54).

29 Claims, 3 Drawing Sheets

(58) Field of Classification Search
USPC ..... 219/736, 738, 744, 745, 748–750, 751, 219/753, 754
See application file for complete search history.

(56) References Cited

U.S. PATENT DOCUMENTS 3,597,567 A * 8/1971 Johnson ..... H05B 6/782 219/693
4,303,817 A * 12/1981 Klement et al. ..... 219/738
4,496,814 A * 1/1985 Fitzmayer ..... H05B 6/642 219/746
4,641,006 A * 2/1987 Ross ..... H05B 6/72 219/746
5,155,317 A 10/1992 Lee
6,118,112 A * 9/2000 Osepchuk et al. ..... 219/749
6,172,348 B1 * 1/2001 Yoshino et al. ..... 219/704
6,614,011 B2 * 9/2003 Omori et al. ..... 219/748
7,511,251 B2 * 3/2009 Baek et al. ..... 219/737
2004/0026415 A1 * 2/2004 Piasentin et al. ..... 219/680

FOREIGN PATENT DOCUMENTS

DE 3738267 5/1989
DE 4135819 A1 * 5/1993
DE 4135819 A1 * 5/1993
JP 2001126859 A * 5/2001
JP 2001126859 A * 5/2001
JP 2003068444 A * 8/2001
JP 2003068444 A * 3/2003

OTHER PUBLICATIONS

International Search Report for PCT/EP2010/002627, dated Aug. 4, 2010, 2 pages.

* cited by examiner

MICROWAVE SEALING DEVICE OF AN OPENING FOR A ROTATING SHAFT

The present invention relates to a microwave sealing device of an opening for a rotating shaft or axle. Further, the present invention relates to a microwave oven with at least one sealing device of an opening for a rotating shaft 10 or axle.

Microwave ovens generate strong electromagnetic or magnetic fields in order to heat food stuff and beverages. However, such strong electromagnetic fields are a potential threat to the health of the operator, if said electromagnetic fields or parts of them leave the cavity of the microwave oven. The openings of the cavity are very critical parts.

In particular, the opening for a rotating shaft or axle, e.g. for a hot air fan, is a critical point. Due to the axial movement caused by the fast rotation of the shaft, the diameter of the opening in the wall is often bigger than the diameter of the enclosed rotating object. It is necessary to seal such openings.

Known solutions for sealing such an opening tend to be very bulky or are prone to mechanical tolerances with respect to the leakage. Further, the heat transfer due to the direct metal contact between the hot cavity wall and the sealing can cause problems on the electric components. For example, the electric drives of the fan, the turn table or the motor of other rotating components.

It is the object of the present invention to provide a microwave sealing device of an opening for a rotating shaft or axle, which prevents an excess heat transfer from the cavity wall to the electric components.

This object is achieved by the microwave sealing device according to claim 1.

According to the present invention

- the sealing device is provided for enclosing a section of the shaft or axle,
- the sealing device includes a front panel and a basis part,
- the front panel is formed as a plane disk and comprises a central hole in its centre and a plurality of cuts,
- the basis part is formed as a hollow part with a peripheral wall and two opposing face sides,
- at least one of the two opposing face sides of the basis part is open,
- the basis part comprises a plurality of cuts in the peripheral wall, and
- the front panel is attached at the open face side or at one of the two open face sides, respectively, of the basis part.

The core of the present invention is the front panel with the cuts and the corresponding basis part formed as a hollow part. Both are provided for enclosing a section of the shaft or axle. The shape of the basis part may be arbitrary. The inventive sealing device may be arranged close at the outer side of the cavity wall without any mechanical and electric contact between the sealing device and the cavity wall. Thus, there is no heat transfer from the cavity wall to electric devices.

According to the preferred embodiment of the present invention the cut of the front panel is set forth by a corresponding cut of the basis part. In particular, the cut of the front panel and the corresponding cut of the basis part are substantially orthogonal to each other.

For the application with the microwave oven the front panel may be provided to be arranged parallel to the opening.

According to a first embodiment of the present invention the front panel covers that open face side of the basis part, at which the front panel is attached. In particular, the diameter of the front panel is substantially equal to the diameter of that open face side, at which the front panel is attached.

According to a second embodiment of the present invention that open face side of the basis part, at which the front panel is attached, covers the central hole of the front panel. In particular, the diameter of that open face side of the basis part, at which the front panel is attached, is substantially equal to the diameter of the central hole of the front panel.

For example, the cuts of the front panel may be formed as slots, circular holes, elliptical holes and/or rectangular holes.

In a similar way, the cuts of the basis part are formed as slots, circular holes, elliptical holes and/or rectangular holes.

Preferably, the front panel may comprise a plurality of sectors separated by slots.

Further, the sealing device may be formed as a single piece part.

The sealing device is made of at least one electrically conductive material. In particular, the sealing device is made of metal.

The object of the present invention is further achieved by a microwave oven with at least one sealing device of an opening for a rotating shaft or axle, wherein the microwave oven includes the sealing device as described above.

Figure 2:
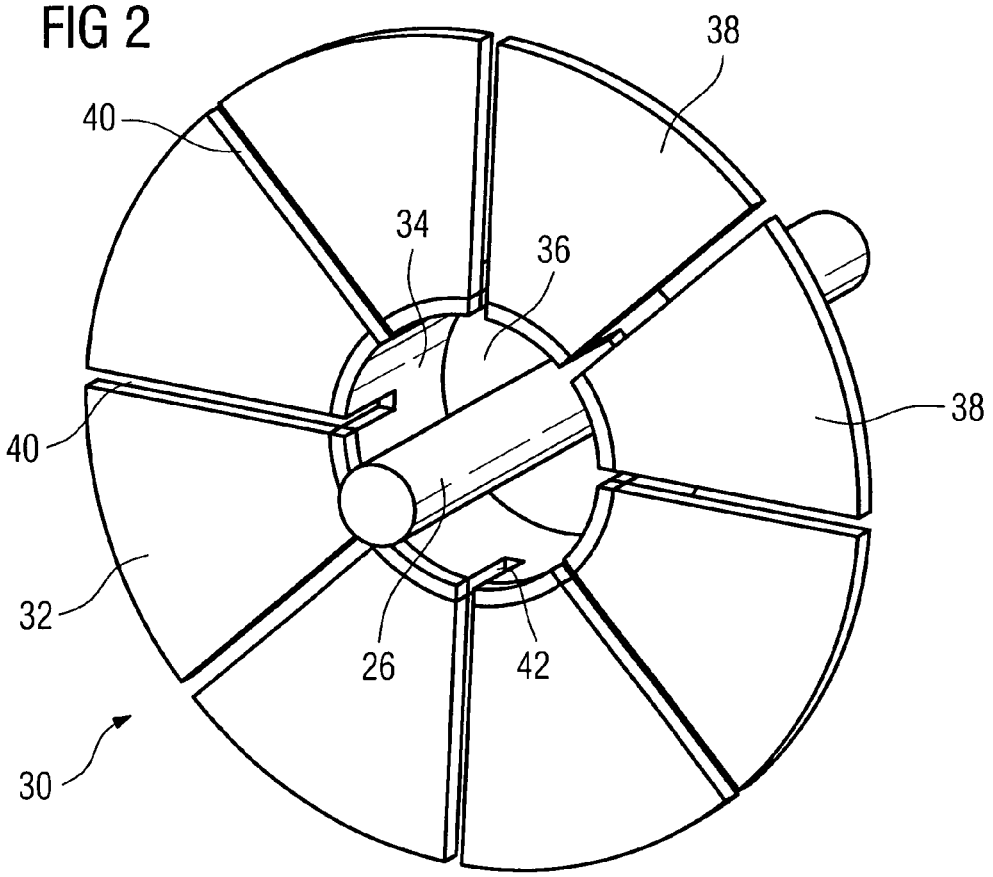
Figure 3:
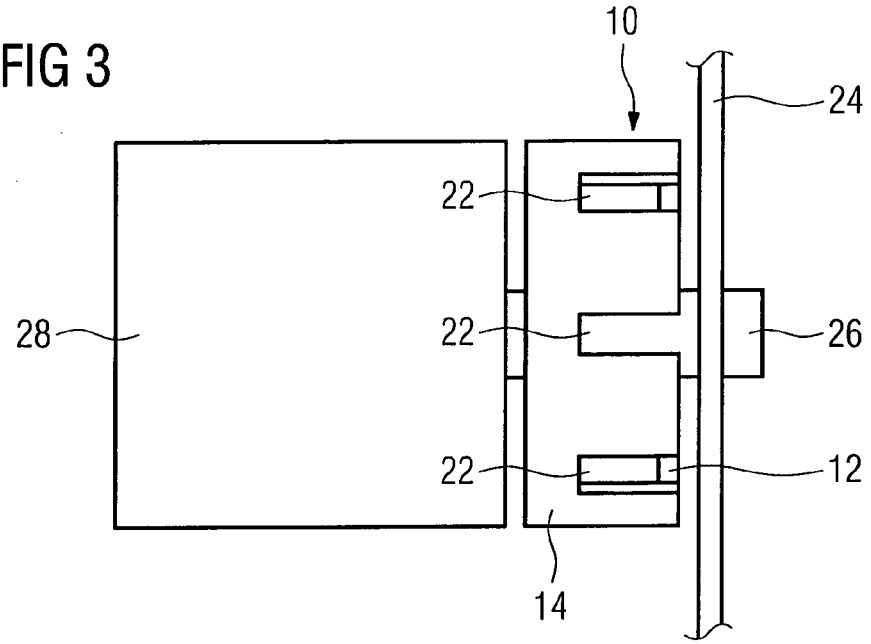
Figure 4:
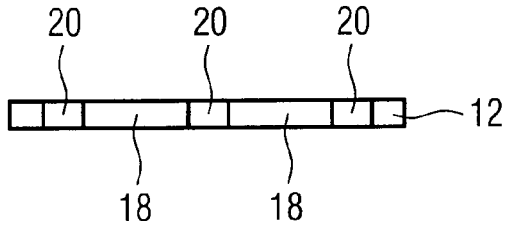
Figure 5:
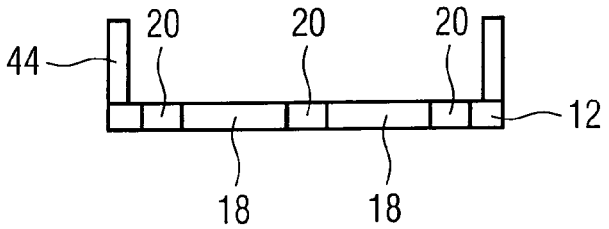
Figure 6:
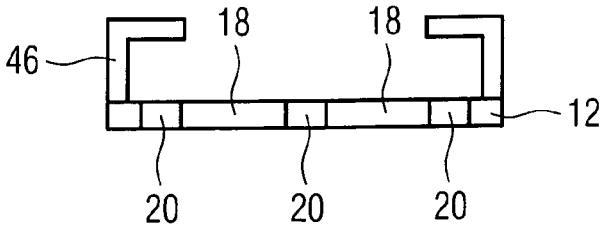
Figure 7:
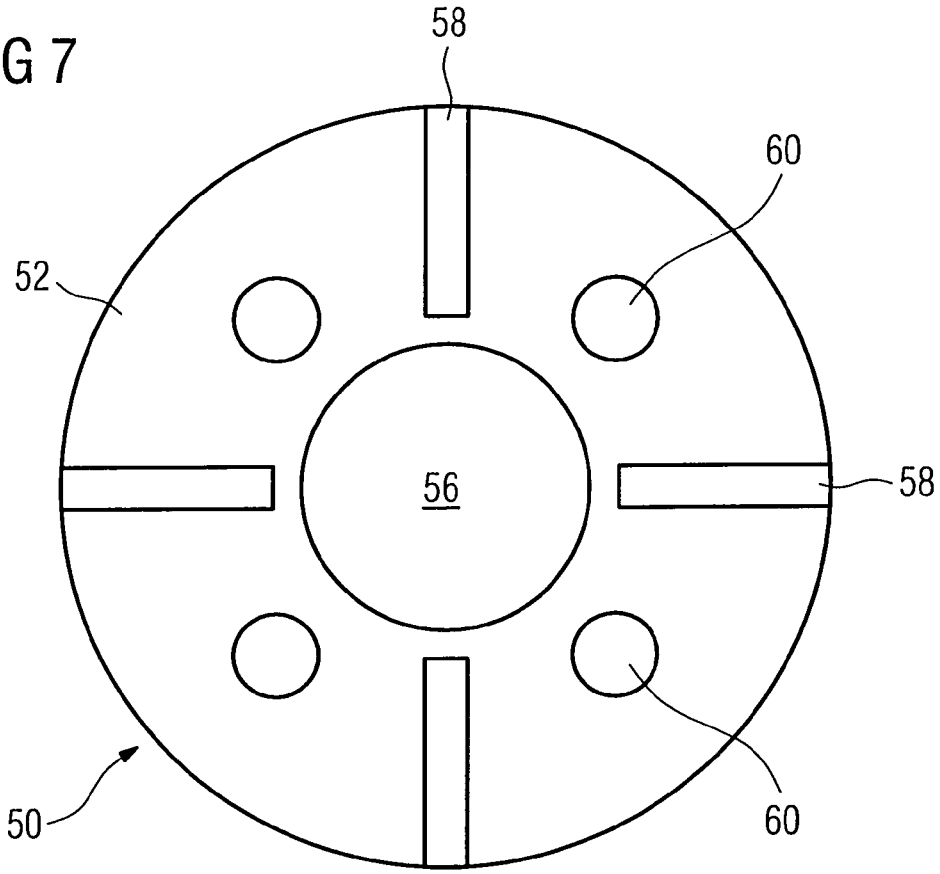
Figure 8:
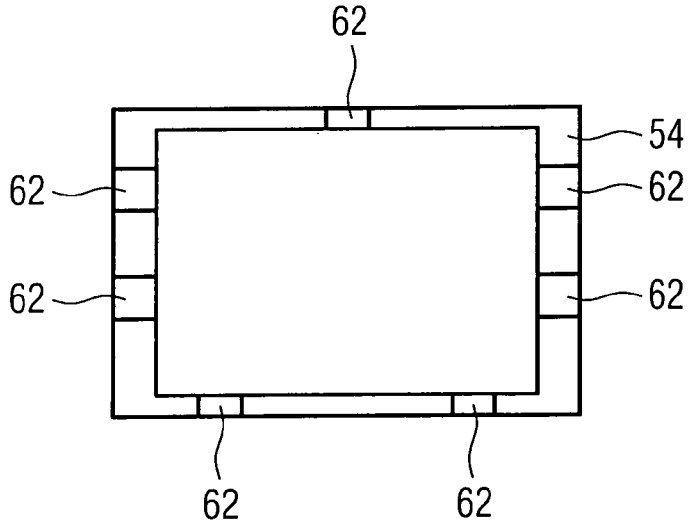

The invention will be explained in more detail below by means of an exemplary embodiment. Reference is thereby made to the drawings, wherein FIG. 1 shows a schematic perspective view of a microwave sealing device of an opening for a rotating shaft or axle according to a first embodiment of the present invention, FIG. 2 shows a schematic perspective view of the microwave sealing device of the opening for the rotating shaft or axle according to a second embodiment of the present invention, FIG. 3 shows a schematic side view of an application of the microwave sealing device according to the first embodiment of the present invention, FIG. 4 shows a schematic top view of a front panel of the sealing device according to the first embodiment of the present invention, FIG. 5 shows a schematic top view of another example of the front panel of the sealing device according to the first embodiment of the present invention, FIG. 6 shows a schematic top view of further example of the front panel of the sealing device according to the first embodiment of the present invention, FIG. 7 shows a schematic front view of the front panel of the sealing device according to a third embodiment of the present invention, and FIG. 8 shows a schematic front view of a basis part of the sealing device according to the third embodiment of the present invention.

FIG. 1 shows a schematic perspective view of a microwave sealing device 10 of an opening for a rotating shaft or axle according to a first embodiment of the present invention. The microwave sealing device 10 comprises a front panel 12 and a basis part 14.

The front panel 12 is formed as a circular disk and comprises a central hole 16 in its centre. The front panel 12 is subdivided into a number of sectors 18. In this example the front panel 12 includes eight equal sectors 18. The sectors 18 are separated by slots 20.

The basis part 14 is formed as a cylinder barrel. The front panel 12 covers one of the two open face sides of the basis part 14. The diameter of the front panel 12 is about equal to the diameter of the basis part 14. The basis part 14 comprises a number of slots 22 extending parallel to the longitudinal axis of said basis part 14. The slots 22 extend over about the half length of the basis part 14. Each slot 22 of the basis part 14 corresponds with one of slot 20 of the front panel 12. Each slot 20 of the front panel 12 is set forth by the corresponding slot 22 of the basis part 14. The corresponding slots 20 and 22 extend perpendicular to each other.

The microwave sealing device 10 is made of an electrically conductive material, in particular made of metal.

The microwave sealing device 10 is provided for sealing the opening for a rotating shaft or axle. Thereby, the shaft or axle extends along the central longitudinal axis of the basis part 14. Further, it is provided, that the shaft or axle penetrates the front panel 12 through the central hole 16 and the basis part 14.

FIG. 2 shows a schematic perspective view of a microwave sealing device 30 of an opening for a rotating shaft 26 or axle according to a second embodiment of the present invention. The microwave sealing device 30 comprises a front panel 32 and a basis part 34.

The front panel 32 is formed as a circular disk with a circular central hole 36 in its centre. The front panel 32 is subdivided into a number of sectors 38. In this example the front panel 12 includes eight equal sectors 38. The sectors 38 are separated by slots 40.

The basis part 34 is formed as a cylinder barrel. The front panel 32 encloses one of the two open face sides of the basis part 34. The inner diameter of the front panel 32 corresponds with the central hole 16 and is about equal to the diameter of the basis part 14. The basis part 14 comprises a number of slots 42 extending parallel to the longitudinal axis of said basis part 34. The slots 42 extend over about the half length of the basis part 34. Each slot 42 of the basis part 34 corresponds with one of slot 40 of the front panel 32. Each slot 40 of the front panel 32 is set forth by the corresponding slot 42 of the basis part 34. The corresponding slots 40 and 42 extend perpendicular to each other.

The microwave sealing device 30 is also made of an electrically conductive material, in particular made of metal.

The microwave sealing device 30 is provided for sealing the opening for the rotating shaft or axle. Thereby, the shaft 26 or axle extends along the central longitudinal axis of the basis part 34. Further, the shaft or axle penetrates the front panel 32 through the central hole 36 as well as the basis part 34.

FIG. 3 shows a schematic side view of an application of the microwave sealing device 10 according to the first embodiment of the present invention.

The microwave sealing device 10 is arranged besides an opening in a cavity wall 24 of a microwave oven. The sealing device 10 is arranged on the outside of the cavity wall 24. The shaft 26 penetrates the opening in the cavity wall 24 and the sealing device 10. The shaft 26 extends perpendicular to the plane of the cavity wall 26. Further, a motor 28 is arranged on the outside of the cavity wall 24. The sealing device 10 is arranged between the motor 28 and the cavity wall 24. The sealing device 10 is attached at the motor 28.

The sealing device 10 is arranged in such a way that there is no mechanical and electric contact between the motor 28 and the cavity wall 24. The sealing device 10 is attached at the motor 28, but not at the cavity wall 24. Thus, there is no substantial heat transfer from the cavity wall 24 to the motor 28.

FIG. 4 shows a schematic top view of a front panel 12 of the sealing device 10 according to the first embodiment of the present invention. FIG. 4 illustrates the arrangement of the sectors 18 and the slots 20. The front panel 12 is formed as a circular disk.

FIG. 5 shows a schematic top view of another example of the front panel 12 of the sealing device 10 according to the first embodiment of the present invention. The front panel 12 is formed in a similar way as in FIG. 4, wherein two additional elements 44 are arranged at the outer portion of the front panel 12. Said elements 44 extend perpendicular to the plane of the front panel 12.

FIG. 6 shows a schematic top view of further example of the front panel 12 of the sealing device 10 according to the first embodiment of the present invention. The front panel 12 is formed in a similar way as in FIG. 4, wherein two additional L-shaped elements 46 are arranged at the outer portion of the front panel 12.

The elements 44 and 46 may act as brackets for fixing the front panel 12 onto the basis part 14.

FIG. 7 shows a schematic front view of a front panel 52 of a sealing device 50 according to a third embodiment of the present invention. The front panel 52 is formed as a circular disk with a circular central hole 56 in its centre. The diameter of said circular hole 56 is about one third of the diameter of the front panel 52. The front panel 52 comprises four slots 58 and four holes 60 alternately arranged along a circumferential direction. The four slots 58 extend in a radial direction of the front panel 52.

FIG. 8 shows a schematic front view of a basis part 54 of the sealing device 50 according to the third embodiment of the present invention. The basis part 54 has a rectangular cross section. The basis part 54 comprises several cuts 62. In this example, the basis part 54 comprises seven cuts 62. The cuts 62 may be formed as slots, circular holes, elliptical holes and/or rectangular holes, for example.

In the above described embodiments there is no mechanical and electric contact between the cavity wall 24 around the opening and the sealing devices 10, 30 and 50.

The sealing device 10, 30 and 50 is made of metal, expanded metal and/or any materials which can be metallised, in particular polymers or ceramics. Further, the sealing device 10, and 50 can be made of materials with electrically conductive fillings or nano technologic materials. The sealing device 10, and 50 may be a single piece part.

In general, the basis part 14, 34 and 54 is a hollow part with an arbitrary shape. Preferably, the basis part 14, 34 and 54 is a hollow cylinder or a hollow part with a rectangular or elliptical cross section.

The shape of the front panel 12, 32 and 52 can differ from the shape of the basis Part 14, 34 and 54. The shapes of the holes 60 in the front panel 12, 32 and 52 are arbitrary, for example circular, elliptical or rectangular. The shapes of the slots 20, 22, 40, 42 and 58 are arbitrary. Preferably, the shapes of the slots 20, 22, 40, 42 and 58 have uniform widths, continuously decreasing or increasing widths or stepped widths. For example, at the angle formed by the front panel 12, 32 and 52 and the basis part 14, 34 and 54 the width of the slots 20, 22, 40, 42 and 58 are stepped.

Alternatively, the slots 20, 22, 40, 42 and 58 can be partially or completely replaced by embossed grooves. Preferably, the slots 20, 22, 40, 42 and 58 and modifications of them, respectively, are aligned, e.g. orthogonal to the edges of the front plate or parallel to the shaft 26.

The sealing device 10, 30 and 50 can be modified in order to seal removable subjects, such as a turn spit.

In the above described embodiments the sealing devices 10, 30 and 50 are static parts of the microwave oven. Alternatively, the sealing devices 10, 30 and 50 can be rotatable. In this case the front panel 12, 32 and 52 may not have any mechanical or electric contact to that part, which has to be sealed.

LIST OF REFERENCE NUMERALS

10 sealing device
12 front panel
14 basis part
16 central hole
18 sector
20 slot of the front panel
22 slot of the basis part
24 cavity wall
26 shaft
28 motor
30 sealing device
32 front panel
34 basis part
36 central hole
38 sector
40 slot of the front panel
42 slot of the basis part
44 element
46 element
50 sealing device
52 front panel
54 basis part
56 central hole
58 slot of the front panel
60 hole of the front panel
62 cut of the basis part

The invention claimed is:

1. A microwave sealing device for sealing an opening in a cavity wall (24) of a microwave oven for a rotating shaft (26) or axle, said sealing device comprising:

a front panel (12; 32; 52) formed as a plane disk, said front panel (12; 32; 52) comprising a central hole (16; 36; 56) in the centre of the front panel (12; 32; 52) and a plurality of cuts or slots (20; 40; 58, 60), and a basis part (14; 34; 54) formed as a hollow part with a peripheral wall and two opposing face sides, wherein at least one of the two opposing face sides of the basis part (14; 34; 54) is open, wherein the front panel (12; 32; 52) is attached at said open side of the one of the two opposing face sides of the basis part (14; 34; 54), said basis part (14; 34; 54) comprising a plurality of cuts or slots (22; 42; 62) in the peripheral wall of the basis part (14; 34; 54), wherein:

the sealing device encloses a section of the rotating shaft (26) or axle.

2. The microwave sealing device according to claim 1, characterized in that each cut or slot (20; 40; 58, 60) of the front panel (12; 32; 52) corresponds to a cut or slot (22; 42; 62) of the basis part (14; 34; 54).

3. The microwave sealing device according to claim 2, characterized in that each cut (20; 40; 58, 60) of the front panel (12; 32; 52) and the corresponding cut or slot (22; 42; 62) of the basis part (14; 34; 54) are substantially orthogonal to each other.

4. The microwave sealing device according to claim 1, characterized in that the front panel (12; 32; 52) is parallel to the opening.

5. The microwave sealing device according to claim 1, characterized in that the front panel (12; 32; 52) partially covers said open side of the one of the two opposing face sides of the basis part (14; 34; 54), at which the front panel (12; 32; 52) is attached.

6. The microwave sealing device according to claim 5, characterized in that the diameter of the front panel (12; 32; 52) is substantially equal to the diameter of the open side of the one of the two opposing face sides of the basis part (14; 34; 54), at which the front panel (12; 32; 52) is attached.

7. The microwave sealing device according to claim 1, characterized in that the diameter of the open side of the one of the two opposing face sides of the basis part (14; 34; 54), at which the front panel (12; 32; 52) is attached, is larger than the diameter of the central hole (16; 36; 56) of the front panel (12; 32; 52).

8. The microwave sealing device according to claim 1, characterized in that the diameter of the open side of the one of the two opposing face sides of the basis part (14; 34; 54), at which the front panel (12; 32; 52) is attached, is substantially equal to the diameter of the central hole (16; 36; 56) of the front panel (12; 32; 52).

9. The microwave sealing device according to claim 1, characterized in that the cuts or slots (20; 40; 58, 60) of the front panel (12; 32; 52) are formed as at least one of slots, circular holes, elliptical holes or rectangular holes.

10. The microwave sealing device according to claim 1, characterized in that the cuts or slots (22; 42; 62) of the basis part (14; 34; 54) are formed as at least one of slots, circular holes, elliptical holes or rectangular holes.

11. The microwave sealing device according to claim 1, characterized in that the front panel (12; 32; 52) comprises a plurality of sectors (18; 38) separated by slots (20; 40).

12. The microwave sealing device according to claim 1, characterized in that the sealing device is formed as a single piece part.

13. The microwave sealing device according to claim 1, characterized in that the sealing device is made of at least one electrically conductive material.

14. The microwave sealing device according to claim 13, characterized in that the sealing device is made of metal.

15. The microwave sealing device according to claim 1, wherein the sealing device is arranged outside the microwave cavity wall.

16. The microwave sealing device according to claim 1, wherein the sealing device is arranged as a static part of a microwave oven.

17. The microwave sealing device according to claim 1, wherein the sealing device is arranged as a rotating part of a microwave oven.

18. The microwave sealing device according to claim 1, wherein basis part (14; 34; 54) is formed as a hollow cylinder.

19. The microwave sealing device according to claim 1, wherein basis part (14; 34; 54) is formed as a hollow part with a rectangular or elliptical cross section.

20. The microwave sealing device according to claim 1, wherein basis part (14; 34; 54) is formed as a cylinder barrel.

21. The microwave sealing device according to claim 1, wherein the plurality of cuts or slots (22; 42; 62) in the peripheral wall of the basis part (14; 34; 54) extend parallel to the central longitudinal axis of the basis part (14; 34; 54).

22. The microwave sealing device according to claim 1, wherein the peripheral wall of the basis part (14; 34; 54) is contiguous with a perimeter of the plurality of cuts or slots (20; 40; 58, 60) in the front panel (12; 32; 52).

23. The microwave sealing device according to claim 1, further comprising two additional elements (44; 46) for fixing the front panel (12; 32; 52) onto the basis part (14; 34;

54), said two additional elements (44; 46) being arranged at an outer portion of the front panel (12; 32; 52) and extending perpendicularly to a plane of the front panel (12; 32; 52).

24. A microwave sealing device for sealing an opening in a cavity wall (24) of a microwave oven for a rotating shaft (26) or axle, said sealing device comprising:

a front panel (12; 32; 52) formed as a plane disk, said front panel (12; 32; 52) comprising a central hole (16; 36; 56) in the centre of the front panel (12; 32; 52) and a plurality of cuts or slots (20; 40; 58, 60), and a basis part (14; 34; 54) formed as a hollow part and one open end, wherein the front panel (12; 32; 52) is attached at an opposite end of the basis part (14; 34; 54), said basis part (14; 34; 54) comprising a plurality of cuts or slots (22; 42; 62) in a peripheral wall of the basis part (14; 34; 54), said cuts or slots (22; 42; 62) extending over less than an entire length of the peripheral wall of the basis part (14; 34; 54), wherein:

a motor (28) is arranged outside of the cavity wall (24) and the sealing device is arranged between the motor (28) and the cavity wall (24), said sealing device being attached at the motor (28) and said sealing device being arranged besides the opening in the cavity wall (24) and close at an outer side of the cavity wall (24) without being attached at the cavity wall (24), the sealing device encloses a section of the rotating shaft (26) or axle, the rotating shaft (26) or axle penetrates the opening in the cavity wall (24) and the sealing device (10), the rotating shaft (26) or axle extends along a central longitudinal axis of the basis part (34) and penetrates the front panel (32) and the basis part (34) through the central hole (36), and the sealing device reduces an escape of electromagnetic fields from a microwave cavity and prevents an excess heat transfer from an interior of the microwave cavity to peripheral components of the microwave oven, wherein each cut or slot (20; 40; 58, 60) of the front panel (12; 32; 52) corresponds to a cut or slot (22; 42; 62) of the basis part (14; 34; 54), and wherein each cut (20; 40; 58, 60) of the front panel (12; 32; 52) and the corresponding cut or slot (22; 42; 62) of the basis part (14; 34; 54) are substantially orthogonal to each other.

25. A microwave sealing device for sealing an opening in a cavity wall (24) of a microwave oven for a rotating shaft (26) or axle, said sealing device comprising:

a front panel (12; 32; 52) formed as a plane disk, said front panel (12; 32; 52) comprising a central hole (16; 36; 56) in the centre of the front panel (12; 32; 52) and a plurality of cuts or slots (20; 40; 58, 60), and a basis part (14; 34; 54) formed as a hollow part with a peripheral wall and one open end, wherein the front panel (12; 32; 52) is attached at an opposite end of the basis part (14; 34; 54), said basis part (14; 34; 54) comprising a plurality of cuts or slots (22; 42; 62) in the peripheral wall of the basis part (14; 34; 54), said cuts or slots (22; 42; 62) extending over less than an entire length of the peripheral wall of the basis part (14; 34; 54), wherein:

a motor (28) is arranged outside of the cavity wall (24) and the sealing device is arranged between the motor (28) and the cavity wall (24), said sealing device being attached at the motor (28) and said sealing device being arranged besides the opening in the cavity wall (24) and close at an outer side of the cavity wall (24) without being attached at the cavity wall (24), the sealing device encloses a section of the rotating shaft (26) or axle, the rotating shaft (26) or axle penetrates the opening in the cavity wall (24) and the sealing device (10), the rotating shaft (26) or axle extends along a central longitudinal axis of the basis part (34) and penetrates the front panel (32) and the basis part (34) through the central hole (36), and the sealing device reduces an escape of electromagnetic fields from a microwave cavity and prevents an excess heat transfer from an interior of the microwave cavity to peripheral components of the microwave oven.

26. The microwave sealing device according to claim 25, characterized in that the front panel (12; 32; 52) partially covers the opposite end of the basis part (14; 34; 54), at which the front panel (12; 32; 52) is attached.

27. The microwave sealing device according to claim 26, characterized in that the diameter of the front panel (12; 32; 52) is substantially equal to the diameter of the opposite end of the basis part (14; 34; 54), at which the front panel (12; 32; 52) is attached.

28. The microwave sealing device according to claim 25, characterized in that the diameter of the opposite end of the basis part (14; 34; 54), at which the front panel (12; 32; 52) is attached, is larger than the diameter of the central hole (16; 36; 56) of the front panel (12; 32; 52).

29. The microwave sealing device according to claim 26, characterized in that the diameter of the opposite end of the basis part (14; 34; 54), at which the front panel (12; 32; 52) is attached, is substantially equal to the diameter of the central hole (16; 36; 56) of the front panel (12; 32; 52).

* * * * *